United States Patent [19]

Stelma et al.

[11] Patent Number: 4,681,012

[45] Date of Patent: Jul. 21, 1987

[54] DRUMMER'S GLOVE

[76] Inventors: Michael J. Stelma, 20624 Hunt Club, Harper Woods, Mich. 48225; Paul R. Dehem, 4662 Yorkshire, Detroit, Mich. 48224

[21] Appl. No.: 897,510

[22] Filed: Aug. 18, 1986

[51] Int. Cl.[4] ..... G10D 13/06; A41D 19/00

[52] U.S. Cl. ..... 84/422 S; 84/411 R; 2/160; 2/163

[58] Field of Search ..... 2/21, 160, 161 R, 163; 84/422 S, 322, 411 R

[56] References Cited

U.S. PATENT DOCUMENTS

| | | | |
|---|---|---|---|
| 1,055,838 | 3/1913 | Torrance | 2/161 R |
| 1,174,887 | 3/1916 | Meriwether | 2/21 X |
| 1,205,229 | 11/1916 | Linden | 2/161 R |
| 1,642,311 | 9/1927 | Richardson | 2/163 X |
| 1,885,843 | 11/1932 | Langer | 84/322 |
| 2,780,954 | 2/1957 | Bryce | 2/160 X |
| 3,027,794 | 4/1962 | Chute | 2/160 X |
| 3,046,561 | 7/1962 | Marinese et al. | 2/21 |
| 4,272,849 | 6/1981 | Thurston et al. | 2/161 R X |

FOREIGN PATENT DOCUMENTS

| | | | |
|---|---|---|---|
| 712006 | 9/1941 | Fed. Rep. of Germany | 2/160 |
| 173536 | 2/1935 | Switzerland | 2/21 |

*Primary Examiner*—William Price
*Assistant Examiner*—T. Graveline
*Attorney, Agent, or Firm*—Barnes, Kisselle, Raisch, Choate, Whittemore & Hulbert

[57] ABSTRACT

A percussion appliance for application to the hand or finger of a drummer in the form of a glove having hard surfaces on the palm side of the fingers extending down to the palm or an individual elongate plate fastened to one or more fingers on the palm side extending from the top of the finger palm crease. A resilient material may be interposed between the percussion surface an the finger to absorb the shock of the percussion use.

2 Claims, 6 Drawing Figures

DRUMMER'S GLOVE

FIELD OF INVENTION

A glove for drummers to be substituted for drumsticks.

BACKGROUND AND OBJECTIVES

Drums traditionally are played with the use of drumsticks in the hands of the drummer. However, in the case of a handicapped person or to get different effects, a glove may be used to obtain a similar effect on an acoustic drum of the standard type or on a synthesized drum disc or cymbals. The present invention is directed to a glove which in itself has no tonal quality but which is used by the wearer to strike a drum surface to produce identical drumming sounds as if done with traditional drumsticks. The disclosed device can increase the performer's abilities, increase the speed with which percussion can be achieved, and expand the complexities of rhythms. It can also be used by amateurs to achieve results similar to drumsticks without the training which is usually required.

Glove and hand attachments are disclosed in previously issued patents as exemplified in U.S. Pat. No. 1,885,843 (1932) which discloses fingertip tapping elements, U.S. Pat. No. 2,736,034 (1956) which discloses weighted fingertips for exercise purposes; and German Patentschrift No. 712,006 (1941) which discloses fingertip balls for achieving percussion effect such as produced by Spanish castanets.

The present invention has an object to provide a drummer's glove which can be used to produce all the standard drum effects such as regular rhythms, snare drum effects and the usual cymbal crash without the use of drumsticks.

It is a further object to provide a drummer's glove which protects the finger and hands without diminishing the desired percussion or tonal effects.

Other objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE PRINCIPLES OF THE INVENTION AND THE MANNER AND PROCESS OF USING IT

Briefly, the invention involves the use of a percussion plate to be applied to the palm side of one or more fingers extending from the fingertip to substantially the palm crease at the lower joint of the third finger bone. The percussion plate can span one or more fingers and can be mounted on the inside surface of glove fingers or with bands or clips which engage the outside of the fingers.

Figure 1:
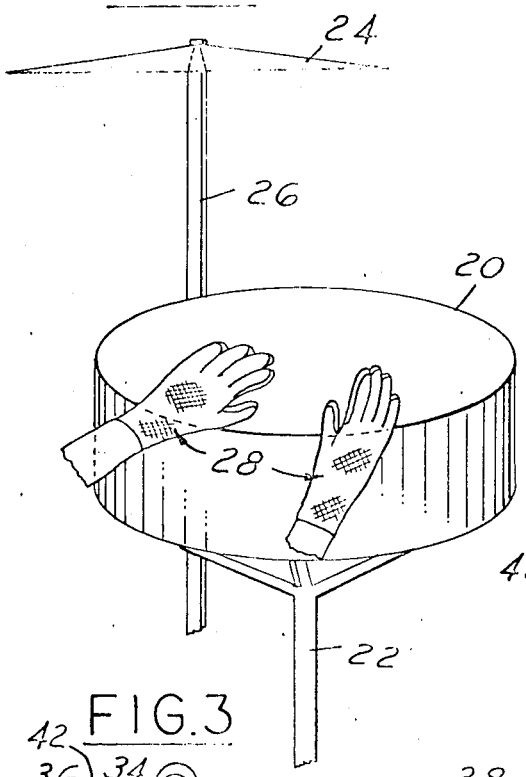
FIG. 1, a view of a drum stand with a cymbal and drum surface.

With reference to the drawings, in FIG. 1, a drum set is illustrated with a drum head 20 on a stand 22 and a cymbal 24 on a post 26. The drum head 20 can either be a standard drum or a drum synthesizer disc.

Figure 2:
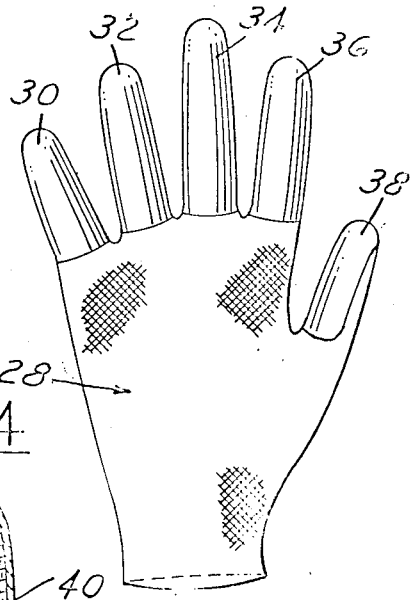
FIG. 2, a palm side view of a drummer's glove with the percussion surfaces shown.
Figure 4:
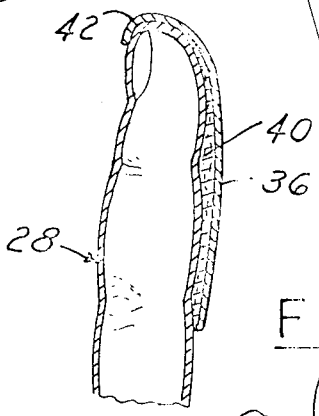
FIG. 4, a longitudinal sectional view of a single finger of a drummer's glove.
Figure 3:
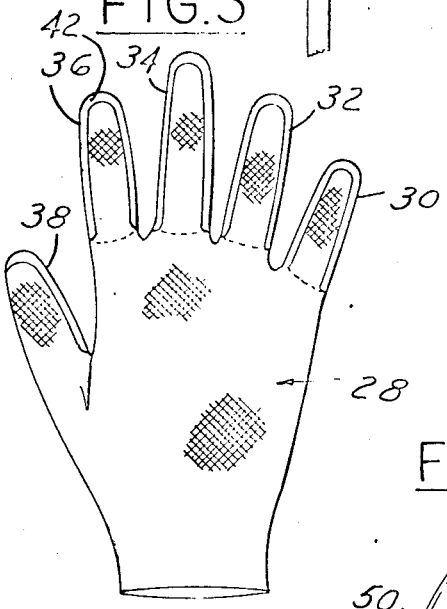
FIG. 3, a view of the backhand side of a drummer's glove.

In FIG. 2, the palm side of a glove 28 is illustrated in which on each of the fingers and the thumb is mounted percussion plates 30, 32, 34, 36 and 38. The plates are formed of a hard material such as metal, hard plastic, fiberglass, wood, or a similar equivalent material. The glove material can be a woven fabric or leather or a simulated leather. Between the plates and the glove is a layer of shock absorbing material 40 such as foam rubber or foamed plastic as illustrated in the longitudinal section of FIG. 4.

The plates and the shock absorbing material can be secured to the glove material with a suitable adhesive, such as epoxy, or by stitching through marginal holes in the plate (not shown).

It is preferable that the percussion plates extend to the palm crease of the lower joint of each finger so that the entire finger is protected if used to crash the cymbal disc. It is also preferable that the plates have a rounded contour at the edges and the digital end which extends over the end of the fingers, as at 42 in FIG. 4 and at 52 in FIG. 5, so that the ends of the fingers can be utilized selectively rather than the palm side of the finger. It is, of course, feasible to utilize right and left hand gloves as shown in FIG. 1. The tips of the fingers can be used for the performance of quarter, eighth, or sixteenth notes on the drum or cymbal and the palm side of the fingers can be used for crashing of the cymbals while the fingers and hands are protected. The independence of each finger provides the ability for maximum rudiments for each hand and also permitting an increase in speed and and expansion of the complexities of rhythm. All fingers can be used on the drum head, acoustic or synthesized.

The thickness of the plate material on the finger can vary in accordance with each performer's preference. Gloves with variant thicknesses can be a part of a drummer's equipment. The thickness, of course, varies with the inertial effect of the percussion and thus the loudness or softness of the response. The density of the material also could be selected as, for example, wood as contrasted with metal, which would create different tonal response.

Acoustic drums will provide a response directly proportional to the user's force applied to the drum head. The force can be modified by using one, two, three or four fingers on each hand and the use of fingertip or whole fingers independently or simultaneously.

Figure 6:
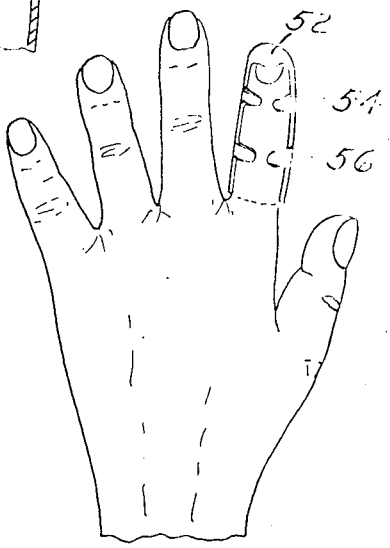
FIG. 6, a view of a hand with a single finger attachment.
Figure 5:
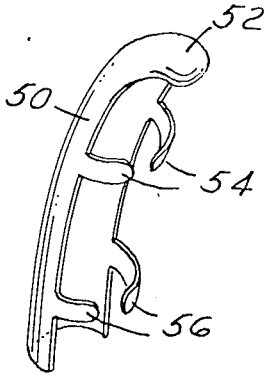
FIG. 5, a perspective view of a single finger attachment for use in percussion.

The invention contemplates individual finger units also as illustrated in FIGS. 5 and 6. In FIG. 5, for example, a percussion plate 50 is shown with a curved fingertip 52. Tabs 54 and 56 are utilized to clamp the plate on the finger. If desired, the plate 50 can be wide enough to span two or more fingers.

With respect to a synthesized drum disc, the response will be similar to that of acoustic drums but controlled by the sensitivity preset on the drum system.

What is claimed is:

1. In combination, a percussion surface in the form of a cymbal, acoustical or synthesized drum to be struck in a timed or rhythmic sequence, and a finger appliance for a percussionist which comprises a dense, hard plate having a rounded contour at the edges and the digital end to be aligned on the palm side of one or more fingers of the percussionist extending from the tip of the finger to the region adjacent the palm, and means to secure each said plate firmly to the finger in a manner to prevent articulation of the finger joints.

2. A method of producing percussion sounds by performing on percussion instruments in the form of a cymbal, acoustical or synthesized drums in a musical ensemble which comprises:

(a) providing a surface of a percussion instrument, (b) providing an accessory on the palm side of one or more fingers of a hand of a percussion player in the form of a dense, stiff, hard plate extending from the finger tip to a region adjacent the palm in a manner to prevent articulation of the finger joints, and (c) utilizing said accessory to strike the surface of a percussion instrument in rhythmic patterns to provide accompaniment for a musical performance.

* * * * *